US005803311A

United States Patent [19]

Fuchs

[11] Patent Number: 5,803,311

[45] Date of Patent: Sep. 8, 1998

[54] BOTTLE CLOSURE FOR SQUEEZING BOTTLE

[75] Inventor: Karl-Heinz Fuchs, Radolfzell, Germany

[73] Assignee: Ing. Erich Pfeiffer GmbH & Co KG, Germany

[21] Appl. No.: 824,217

[22] Filed: Mar. 25, 1997

Related U.S. Application Data

[63] Continuation of Ser. No. 433,832, May 4, 1995, abandoned.

[30] Foreign Application Priority Data

May 19, 1994 [DE] Germany ..... 44 17 488.8

[51] Int. Cl.[6] ..... B65D 35/56

[52] U.S. Cl. ..... 222/105; 222/212; 222/213; 222/481.5; 222/496

[58] Field of Search ..... 222/105, 145.5, 222/145.6, 183, 207, 212, 213, 402.18, 481.5, 496

[56] References Cited

U.S. PATENT DOCUMENTS

| | | | |
|---|---|---|---|
| 3,170,633 | 2/1965 | Castelli | 239/327 |
| 3,474,936 | 10/1969 | McDonnell | 222/212 X |
| 3,593,886 | 7/1971 | Morane | 222/402.18 X |
| 3,743,146 | 7/1973 | Schindler | 222/496 X |
| 3,828,985 | 8/1974 | Schindler | 222/496 X |
| 4,161,288 | 7/1979 | McKinney | 239/333 |
| 4,356,978 | 11/1982 | Krauss | 239/533.12 |
| 4,387,854 | 6/1983 | Dupont | 239/570 |
| 4,650,094 | 3/1987 | Werding | 222/55 V |
| 4,673,110 | 6/1987 | Workum | 222/211 |
| 4,723,725 | 2/1988 | Comment | 222/496 X |
| 5,273,191 | 12/1993 | Meshberg | 222/105 |

FOREIGN PATENT DOCUMENTS

| | | | |
|---|---|---|---|
| 2684081 | 5/1993 | France . | |
| 212019 | 8/1984 | German Dem. Rep. . | |
| 8706441 | 8/1987 | Germany . | |
| 3936365 | 5/1991 | Germany . | |
| 9107580 | 11/1992 | Germany . | |
| 4134885 | 4/1993 | Germany . | |
| 4216915 | 11/1993 | Germany . | |
| 4239847 | 6/1994 | Germany . | |
| 2220408 | 1/1990 | United Kingdom | 222/481.5 |

*Primary Examiner*—Joseph Kaufman
*Attorney, Agent, or Firm*—Quarles & Brady

[57] ABSTRACT

A dispenser for discharging media to be used in conjunction with a pressure chamber comprises: a medium outlet; an outlet channel leading into the medium outlet, the outlet channel defining a medium flow in operation, the outlet channel, at a distance from the medium outlet, having a channel portion provided to connect to the pressure chamber and operable for producing a delivery pressure in a range of increasing medium pressures, from a relatively lower medium pressure to a relatively higher medium pressure, the outlet channel having adjustable passage cross-sections; and, a controller for increasing the passage cross-sections to a relatively larger cross-section at relatively lower medium pressure and to constrict the passage cross-sections smaller than the relatively larger cross-section at the relatively higher medium pressure.

26 Claims, 2 Drawing Sheets

BOTTLE CLOSURE FOR SQUEEZING BOTTLE

CROSS-REFERENCE TO RELATED APPLICATION

This application is a continuation of U.S. patent application Ser. No. 08/433,832, filed May 4, 1995 now abandoned.

BACKGROUND OF THE INVENTION

The invention relates to a discharge apparatus for one or more media, whereof at least one can be non-gaseous, e.g. liquid, pulverulent, etc. and/or at least one can be gaseous, e.g. air. Such discharge apparatuses can be formed solely by a discharge head for fixing to a pressure generator, such as a thrust piston pump, a compression or bellows pump, etc. or can form a constructional unit with such a pressure generator or an associated medium reservoir.

The discharge apparatus has one or more medium outlets, outlet channels, volume-variable chambers for manual pressure generation, valves or flow-varying control or adjusting bodies, etc., which guide the medium responsive to actuation. Actuation can occur by direct manual actuation which narrows the pressure chamber. Actuation can also occur by charging the pressure chamber to a delivery pressure and manually opening the outlet channel.

In such discharge apparatuses there is a need to influence the flow behavior in zones spaced upstream from close to or after the medium outlet. For example, the medium flow during the time of a single discharge process can be influenced for adapting to changes in the delivery pressure or can be influenced in order to obtain an optimum precise dosing of the discharge quantity per discharge process.

SUMMARY OF THE INVENTION

An object of the invention is to provide a discharge apparatus avoiding the disadvantages of known constructions or leading to advantages compared therewith for example in apparatus of the aforementioned type A simple construction permits a random influencing of the medium flow after leaving the pressure chamber at a random point between said pressure chamber and the medium outlet adjacent to the open environment.

According to the invention a core or other adjusting body for varying the medium flow is provided in such a way that with increasing delivery pressure, a narrowing or the like of a passage cross-section is possible. This modification of the passage cross-section can take place by separate manual actuation in such a way that the particular setting is maintained independently of the actuation or delivery pressure, and/or can be path dependent of the actuation or pressure-dependent, namely automatic as a consequence of said discharge actuation of the discharge apparatus.

If at least one medium outlet is formed by a relatively narrow nozzle of less than 8, 4 or 1 mm, and in particular by an atomizing nozzle, whose flow paths form a nozzle geometry influencing the flow behavior, then independently of the described construction, a control or adjusting body can be provided for varying said nozzle geometry in such a way that the passage cross-sections of the discharge nozzle are variable. The changes can always leave free passage cross-sections or completely close the outlet or discharge channel in such a way that at least one medium is blocked against access to the medium outlet.

The adjusting body can also be used for varying the flow geometry and therefore the flow-influencing action of a turbulence or whirling chamber, in which separate media are brought together for mixing or the like or transformed into turbulent or rotary flows.

In particular a control or adjusting body can have, following on to an inner and/or outer circumference, a substantially planar or at the most flat, obtuse-angled end or control face, which is movable through the adjusting movement with respect to a correspondingly constructed opposite face and with the latter defining a disk-shaped, flat, but variable passage gap. A longitudinal channel transversely connected to the outer circumference of this passage gap can remain substantially unmodified or can be modified by the adjusting movement with respect to its flow-influencing action or its passage cross-sections.

It is particularly appropriate to provide at least two passage cross-sections variable by the adjusting movement in spaced manner in the delivery direction, or in immediately succeeding form, and which are modified in opposition. If one passage cross-section is increased or leads to a more quiet flow, the other is appropriately decreased or brings about a more turbulent or faster flow and vice versa. Advantageously the arrangement is such that during the discharge feed, the first passage cross-section in the flow direction is increased and the second is decreased, or in that the return movement is given a reversed sequence.

The path of an adjusting body from the starting position to the end position can also be used for dosing or limiting the discharge quantity, or to end the discharge, despite the actuation of the discharge apparatus and the delivery pressure consequently prevailing in the pressure chamber, although e.g. a discharge valve opening in pressure-dependent manner is completely opened. For this purpose, between the valve seat and a narrow flow channel following onto the same in the flow direction, there is a widened, ring or disk-shaped, flat intermediate chamber into which the medium enters directly from the valve seat and which can also be penetrated by the valve or adjusting body.

Such an intermediate chamber or some other chamber can also be constructed as a pump or displacement chamber, volume-variable by an adjusting body, and from which the medium is displaced during movements of the adjusting body, so that as a result additional delivery energy is provided. As a result of this or also through other means, an adjusting body can ensure that the medium discharge starts suddenly, virtually with the maximum discharge energy and/or is suddenly ended, so that there is no slowly rising or falling discharge, but instead an intermediate medium discharge. This is particularly advantageous for a very finely atomized discharge, so as to also ensure a very fine atomization at the beginning and/or end of the discharge. The medium outlet can also be formed by a foam nozzle, in whose vicinity is foamed a foamable medium, e.g. accompanied by the supply of a gas, the foam formation being influenced by an adjusting or control body.

The adjusting body can be driven by a piston via an intermediate drive, but it is appropriately rigidly or integrally connected to said piston in such a way that it is necessarily, simultaneously or synchronously driven and there is a direct mechanical drive. The adjusting body can be formed by a piston and the piston by a valve body.

An adjusting body can have each of the said constructions and effects in random combination or it is possible to provide for the same separate adjusting bodies. It is particularly appropriate if the adjusting body forms a preinstalled subassembly with a mounting, a valve seat, a return spring, a piston or valve body, a closure for the pressure chamber, and the like, which can be subsequently installed on the casing forming the pressure chamber. A discharge head includes the medium outlet, etc. and can appropriately be fixed between the two latter subassemblies.

It is particularly advantageous to provide, in the vicinity of an adjusting body or in the flow direction following the same, a second medium flow supply or a supply of a second medium to the first medium flow, whereby said second medium can have a different aggregate state from the first medium, e.g. can be gaseous. This significantly improves the atomization or foaming or the supply of the second medium to the medium outlet or the like can begin before the corresponding supply of the first medium or can end after the end of the supply of the second medium.

A dispenser for discharging media to be used in conjunction with a pressure chamber, in accordance with an inventive arrangement, comprises: a medium outlet defined by a first duct end of a linear end duct including a second duct end remote from the first duct end; an outlet channel leading into the end duct, the outlet channel defining a medium flow with a flow direction toward the medium outlet during dispensing operation, the outlet channel having a channel portion directly connecting to the end duct, the channel portion including channel boundaries including an inner circumferential surface and a recessed end face directly connecting to the inner circumferential surface, the channel portion connecting to the pressure chamber and being operable for producing a delivery pressure in an increasing range between a relatively lower medium pressure and a relatively higher medium pressure, the channel portion determining passage cross-sections; a core body operatively bounding the channel portion opposite to the channel boundaries, the core body being operationally unidirectionally movable from an initial control position to a control end position in a first control direction defined by a first core motion for varying the medium flow and for modifying the medium flow together with the increasing medium pressure to thereby vary the passage cross-sections, wherein the core body has outer faces including an outer circumferential face and a free end face, the outer faces directly facing the channel boundaries, in the initial control position of the core body and of the dispenser, the outer faces and the channel boundaries commonly bounding an angular passage gap for passing the medium, the angular passage gap including an axial gap leg defining first flow cross-sections, the first flow cross-sections being constant during the first core motion and the dispensing operation, the passage gap including a transverse gap leg directly connecting to the axial gap leg at an angle and defining second flow cross-sections, the second flow cross-sections varying substantially continuously during the first core motion and the dispensing operation, the transverse gap leg being oriented transverse to the first control direction and being located downstream of the axial gap leg, the transverse gap leg being bounded by a groove.

A dispenser for discharging media to be used in conjunction with a pressure chamber, in accordance with another inventive arrangement comprises: a medium outlet defined by a first duct end of a linear end duct including a second duct end remote from the first duct end; an outlet channel leading into the end duct, the outlet channel defining a medium flow with a flow direction toward the medium outlet during dispensing operation, the outlet channel having a channel portion at a distance upstream from the medium outlet, the channel portion connecting to the pressure chamber and being operable for producing a delivery pressure in an increasing range from a relatively lower medium pressure to a relatively higher medium pressure, the outlet channel determining passage cross-sections; a core body operatively associated with the outlet channel and movable during the dispensing operation in a first control direction from an initial control position to a control end position by a first core motion for varying the medium flow, the core body being movable in the first core motion for modifying the medium flow together with the increasing delivery pressure to thereby vary at least one of the passage cross-sections; the core body having a circumferential face and an end face connecting to the circumferential face; and, the channel portion including at least one angular channel groove, the at least one angular channel groove including an axial groove leg located at the circumferential face and a transverse groove leg downstream angularly directly connecting to the axial groove leg, the transverse groove leg being oriented transverse to the first control direction and located at the end face.

The transverse groove leg is recessed in the end face including a center chamber, the transverse groove guiding the medium flow radially inwardly into the center chamber.

BRIEF DESCRIPTION OF THE DRAWINGS

These and other features can be gathered from the claims, description and drawings and the individual features, either singly or in the form of subcombinations, and can be implemented in an embodiment of the invention and in other fields and can represent advantageous, independently protectable constructions for which protection is hereby claimed. Embodiments of the invention are described in greater detail hereinafter relative to the drawings.

DETAILED DESCRIPTION OF THE PREFERRED EMBODIMENTS

Figure 1:
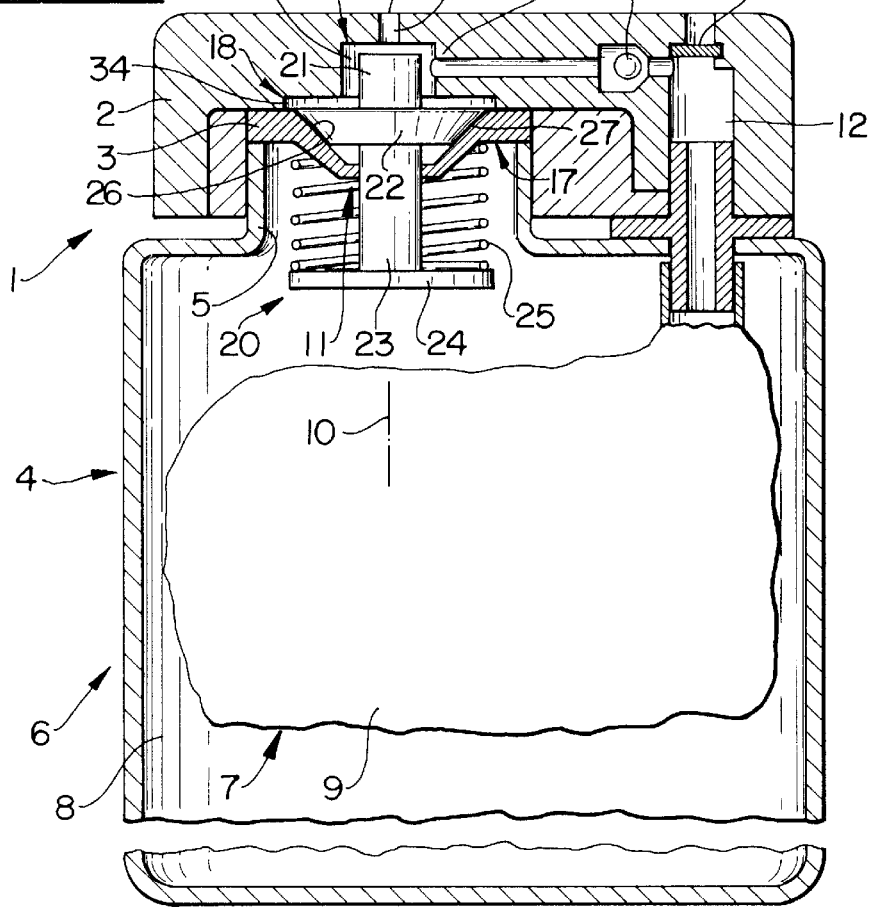
FIG. 1 is a discharge apparatus according to the invention in axial section.

The discharge apparatus 1 has a body 2 and an insert member 3 supported thereon for fixing to the narrowed neck 5 of a container 4, whose container space serves as a medium reservoir for storing two separate media, e.g. a liquid and air. The container 4 is a resilient squeezing bottle with bending-elastic plastic walls resiliently elastic by external manual pressure on the casing and/or at least one end face. However, it can also be dimensionally rigid or contain a propellant, such as an aerosol producing the delivery pressure.

As a result of the compressibility, the container 4 forms a type of balloon pump, whose pressure chamber 3 formed by the storage space for the entire medium supply, is manually volume-modifiable. Within the pressure chamber 8 is a further, identically acting pump 7 for the second medium, for example air, whose pressure chamber 9 is formed by a film bag, which can be non-destructively folded together accompanied by complete emptying in such a way that its volume only roughly corresponds to the material volume of its walls. The pressure chamber 9 is so refilled from the outside with air that the pressure chamber 8, independently of its filling state, does not take up air and instead always remains completely full. The supply of the first medium from the pressure chamber 8, or the subsequent restoring or return of the container walls, leads to a corresponding enlargement of the pressure chamber 9, accompanied by a simultaneous air suction from the outside.

An outlet or discharge channel 11 passes from the pressure chamber 8 through the neck 5 and the bodies 2, 3. An outlet or discharge channel 12 substantially separate therefrom leads from the pressure chamber 9 in spaced manner from the neck 5 through the wall of the container 4 and the body 2. The outlet channels 11, 12 issue into a common medium outlet 13, but before this, the outlet channels are brought together, so that the two media pass in mixed form out of the medium outlet 13. outlet 13 is provided in an exposed outer surface of the body 2. The medium outlet 13 is formed by the outer end 16 of a nozzle or end channel 14, whose diameter is under ½ mm or is 1/10 mm. The cylindrical end channel 14 has, compared with its smallest width, an at the most 3 to 5 times greater length and is widened in funnel-shaped manner at both ends 15, 16 or passes through with a constant inside width up to at least one of said ends.

In the flow direction in the outlet channel 11 are successively provided three flow restrictors or valves 17, 18, 19, which act on the entire medium flow in the outlet channel 11, either for opening and closing the outlet channel or for only for increasing and decreasing the passage cross-sections. All the valves 17 to 19 are simultaneously operated by a single adjusting body 20, which has a core body 21 closer to the end channel 14 and a valve body 22 directly connected to the core body 21 in rigid or axially movable connection. On the side remote from the core body 21, the valve body 22 has a shaft 23 projecting into the neck 5 belonging to the pressure chamber 8 and which carries on the inner end a disk-shaped abutment 24 for a return spring 25. The spring 25 surrounding the shaft 23 is supported by one end on the abutment 24, with the other end on the inner end face of the insert member 3, roughly in the plane of the outer end face of the neck 5.

The ring disk-shaped insert member 3, optionally constructed in one piece with the body 2, forms a frustum-shaped valve seat 26 widened in approximately right-angled manner in the flow direction and provided as an inner circumference, serves for the closing engagement of a similar frustum-shaped closing face 27 on the outer circumference of the disk-shaped valve body 22. The valve seat 26 is formed by a frustum-shaped collar projecting into the neck 5 of the otherwise planar insert member 3, which is so fixed between the body 2 and the end of the neck 5 that it simultaneously forms the bottle closure or the seal between the container opening and the body 2. In the starting position, or with the pump 6 not operated, the valve 17 is tightly closed. The valve body 22 forms a control piston exposed to the pressure in the pressure chamber 8, and which in the case of an over-pressure in the pressure chamber 8, opens the valve 17, accompanied by a displacement of the adjusting body 20 in the flow direction, so that then between the surfaces 26, 27 is formed a passage gap for the medium extending over the circumference.

In the starting position, the valve 18 or 19 is maximally opened. In the maximally opened position of the valve 17, valve 18 or 19 is maximally narrowed or completely closed. The circular, planar valve seat 28 of the valve 18 in the starting position of the larger, diskshaped, planar end face of the valve body 22 has a gap spacing with respect thereto and is formed by a circular depression on an inner end face of the body 2. The closing surface 29 of the valve 18 is formed by the said end face of the valve body 22, the valve seat 28 having a larger external width. Thus, the valve seat 26 is directly connected to the ring disk-shaped gap 34 between the valve surfaces 28, 29, which is also traversed by the core body 21. The greatest width of the valve seat 26 is smaller than the greatest width of the valve seat 28. The greatest width of the valve seat 26 can also correspond to the greatest width of the valve seat 28.

Figure 2:
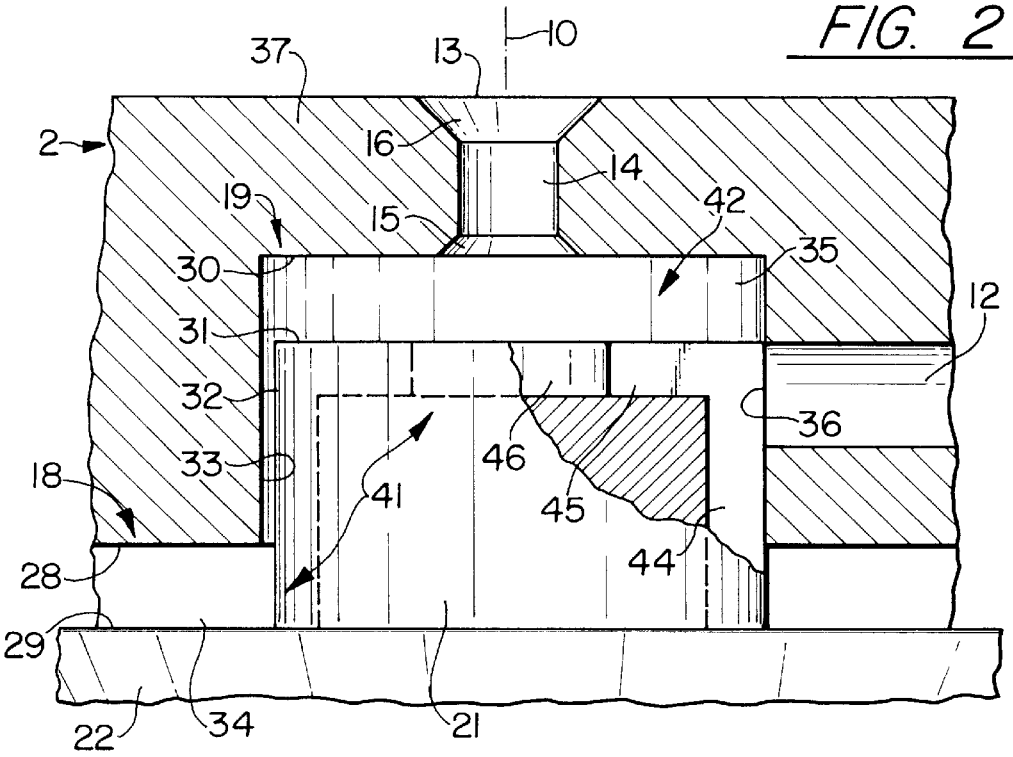
FIG. 2 is a detail of FIG. 1 on a much larger scale and in a modified construction.

In FIG. 2, end channel 14 is provided with a conical inner end 15 and a conical outer end 16. Inner end 15 opens into valve 19, shown in larger scale in FIG. 2. Valve 19 has much narrower valve faces 30, 31, namely, on the body 2 a valve seat 30, and facing the valve face 30, a closing face 31, which is formed by the outermost end face of the core body 21 remote from the valve body 22. The valve faces 30, 31 are also substantially planar and circular. The valve seat 30 surrounds the inner end 15 of the end channel 14, which traverses a one-piece end wall 37 of the body 2. In the starting position, between the valve faces 30, 31, a further, ring disk-shaped passage gap 35 is defined, which is traversed by no component within its outermost circumference and whose axial gap width, as a function of requirements, can be the same, larger or smaller than that of the passage gap 34. In the case of a smaller width of the passage gap 35, the closing face 31 strikes against the valve seat 30, so that the gap 34 with the narrowest passage cross-section remains open despite the possibly closed valve 19. With a larger gap width, the closing face 29 impacts, whereas the gap 35 of the valve 19 remains open in the narrowest state. For the same gap width, or same stop spacing, both valves 18, 19 close simultaneously by stop limitation, but means can be provided in order to keep free a minimum passage cross-section through the particular valve 18, 19. One to all the valves or constrictors, the faces thereof, the end channel 14, the medium outlet 13, the neck 5 and the adjusting body 20 are appropriately located substantially in a single central axis 10, with respect to which the container 4 can be equiaxial or eccentric.

The core body 21 has a cylindrical circumferential surface 32, which continues over its entire length and is connected to the end face 31. Surface 32 faces an opposite surface 33 formed by an inner circumferential surface of the body 2 connected to the end faces 28, 30. Between the faces 32, 33, according to FIG. I can be provided an envelope gap 38 passing over the circumference and connecting the gaps 34, 35. According to FIG. 2, the faces 32, 33 can be substantially tight or engage in sliding manner on one another. The length of the envelope gap 38 or the engagement of the core body 21 in the associated depression on the inside of the body 2 in the starting position is greater than the gap width of the gaps 34, 35, so that the core body 21 always engages in the depression. Axial adjusting movements of the core body 21 may have no influence on the passage cross-section of the channel portion 38 connecting the channel portions 34, 35, or can increase or decrease the passage cross-section as a function of the desired discharge behavior.

Chambers 34 and 35 simultaneously form volume-variable pressure or pump chambers, which with increasing delivery pressure, are constricted by the members 22, 21 acting in thrust piston-like manner, and consequently discharge the medium towards the medium outlet 13. The effective piston face of the piston 21 formed by the end face 31 is smaller than the effective piston face 29 or 27. The piston face 27, used for opening, can be larger than the piston face acting in the opposite direction or can be roughly the same size. The openings 12 to 16, 35, 38, the faces 30, 33 and the wall 37 can also be provided on a separate nozzle cap with an approximately constant wall thickness, inserted in fixed manner in the body 2 or movably inserted for performing the adjusting movements, the core body 21 then engaging therein.

The outlet channel 12 terminates in a mouthpiece 36, which is connected approximately radially or tangentially to the outer circumference of one or more of the gaps 34, 35, 38, and appropriately with the core body 21, in the starting position, is directed only against its circumferential surface 32 or is located roughly in the center of the length of the circumferential surface 33. By means of an admission valve 39 opening in pressure-dependent manner, and through a portion of the outlet channel 12, air is sucked from the outside. In the flow direction following the one-way valve 39, closing under overpressure in the chamber 9, an outlet or discharge valve 40 is provided in the outlet channel 12. Outlet or discharge valve 40, e.g. a spring-loaded one-way or overpressure valve, opens when there is overpressure in the chamber 9, so that air appears at the mouthpiece 36 with a correspondingly high pressure. For any position of the core body 21, the mouthpiece 36 can be opened to the same or different extent or in one of the positions, e.g. one or both end positions, such as the starting position, can be closed. The particular chamber or gap into which the mouthpiece 36 issues, simultaneously forms a mixing chamber, in which and as from which the two media are uniformly intermixed by whirling or turbulent action.

In order to further improve the discharge behavior or mixing appropriately, means 41 are provided for influencing the flow and in particular, for modifying the flow direction, speed, turbulence and rotation. For example, the particular chamber 34, 35, 38 can be constructed as a turbulence or whirling chamber, in which one or both media are made to flow-rotate about the central axis 10 in such a way that said rotation continues into the end channel 14, the medium outlet 13 and beyond the same, and consequently, at least one whirling device 42, 43 is formed. The particular whirling chamber 34, 35 can be provided on one or both ends 30, 31 or circumferential surfaces 32, 33 with guide faces of the means 41 or the whirling device 42 in such a way that a strong mixed turbulence or rotary flow is produced.

Along the circumferential surface 32 are provided axial, slotlike longitudinal channels 44 in the core body 21, which with their one ends in each position, are connected open to the channel portion 34, or in at least one position, particularly the end position, are closed by the valve 18. The other end of the longitudinal channel 44 passes in angular manner into a slot-like transverse channel 45 in the end face 31, whose radially inner end remote from the longitudinal channel 44 issues into a dish or cup-shaped depression 46, which is also provided in the end face 31. The bottom of the depression 36 can be located in the plane of the bottom face of the channel 45, or with respect thereto, can be displaced towards or away from the end channel 14.

The width of the depression 46 is greater than that of the channels 44, 45 and in each case one side of each channel 45 is tangentially connected to one end of a portion of the inner circumference of the depression 46, curved in a concave manner about the central axis 10. The passage cross-section of the channel 45 is continuously constricted in funnel-shaped manner towards the chamber 46, e.g. by acute-angled convergence of its facing sides. The length of the channels 44 or the core body 21 can be much the same as the external width thereof, or can be significantly smaller than it. The inside width of the chamber 46 is greater than that of the channel portions 14 or 16 or the inner circumference of the valve seat 30. The depressions 44 to 46 can be provided only in the core body 21 and are then closed or closable at its open slot or depression side by the depression-free faces 33, 30 of the body 2. However, this depression can also be provided exclusively in the surfaces 33, 30 and can be correspondingly closed or closable by the depression-free surfaces 32, 31 of the core body 21. The depression can also be provided in both associated surfaces.

In the embodiment according to FIG. 1 said channels or depressions are not provided, and therefore the valve 19 is closed in the operated end position of the core body 21. In the embodiments according to FIGS. 2 and 3, the valve 19 is not to be completely closed, and instead the line connection from the channels 44 to the medium outlet 13 always remains open. In the depression 46, the first medium, under centrifugal force, is given a right-rotating flow according to FIG. 3 along the inner circumference and around the jointly flowing air located in the center and simultaneously, the first medium passing longitudinally out of the channels 44 by rebounding on the surface 30, is passed back against the surface 31 and the depressions 45, 46, and also the resulting turbulent medium flow on approaching the surface 31 or the depressions 45, 46 on the end channel 14 passes into the latter. At the end of this process the supply of both media to the end channel 14 is abruptly broken off by closing the valves 18, 19, whereas in the embodiment according to FIGS. 2 and 3, only the supply of the first medium is abruptly broken off by closing the valve 18, whereas the second medium continues to flow out through the end channel 14 and can completely clean, with respect to the first medium, the outlet opening 13, channels 14 to 16, chamber 35 and depressions 44 to 46.

According to FIG. 1, the mouthpiece 36 is radially or tangentially directed with radial spacing in each position against the circumferential surface of the core body 21. According to FIG. 2 the mouthpiece 36 in the starting position is radially directed against the transition area between the two channels 44, 45, so that air flows directly from it roughly radially or linearly into the transverse channel 45 and then enters the depression 46. In the other end position, the mouthpiece 46 is directed to almost its full width against the bottom face of the longitudinal channel 44. According to FIG. 3, the opening 36 of the outlet channel 12 issues tangentially onto the circumference 32 or 33, which can have a circumferential channel 47 linking the longitudinal or transverse channels 44, 45, so that the second medium is given a rotary flow on said circumference and roughly simultaneously enters two or more channels 44, 45. The rotary flow in the circumferential channel 47 can be directed in the same or opposite directions to the rotary flow in the depression 46 about the central axis 10. Moreover, the slot depression forming the circumferential channel 47, as described relative to the depressions 44 to 46, can be exclusively provided in the surface 32 or the surface 33 or in both surfaces according to FIG. 3 and can be closed on the open depression side. The channel 47 may only be provided in the vicinity of the longitudinal channels 44, only in the vicinity of the transverse channels 45 or in the transition area between both channels 44, 45. The passage cross-section of the channel 47 can be roughly the same or smaller than that of the outlet channel 12.

Figure 4:
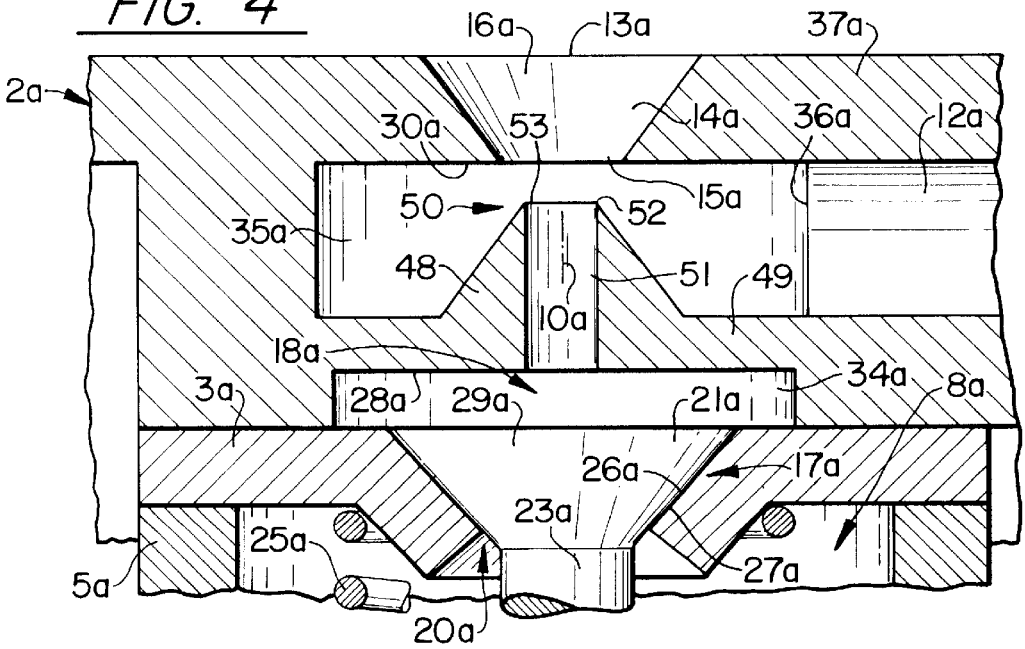
FIG. 4 is another embodiment in a representation corresponding to FIG. 2.
Figure 3:
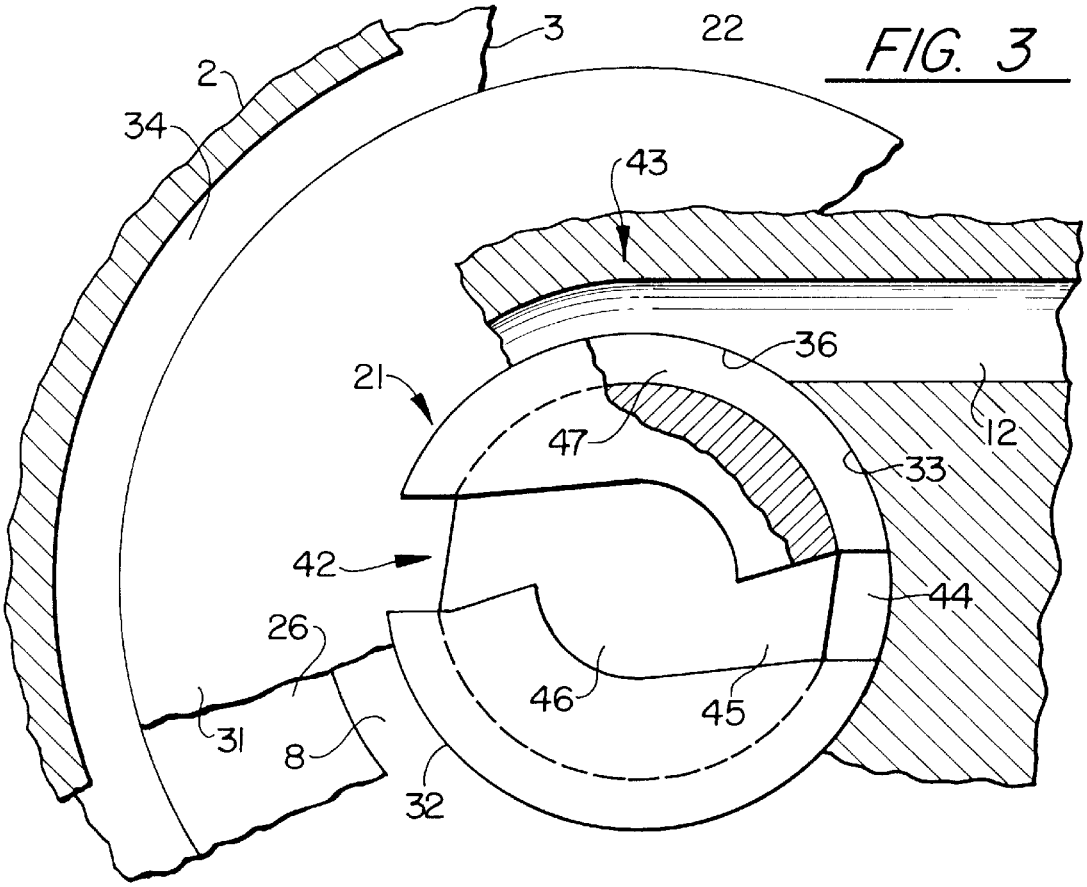
FIG. 3 is a section through the arrangement according to FIG. 2 in a modified construction.

In the embodiment of FIG. 4 the core body 21*a* is directly formed by the body of the valve 17*a* which, unlike in FIGS. 1 to 3, does not carry the core projection on its widest end face 29*a*, and instead, is continuously planar or provided with depressions. The chamber 34*a* is separated by an intermediate wall 49 from the chamber 35*a*, having a larger axial extension and one side thereof forming the end face 28*a* of the valve 18*a*. The other side of the wall 49 facing the end channel 14*a* carries a projection 48, projecting freely into the chamber 35*a* and forming a nozzle 50 located in the central axis 10*a*. The projection 48 tapers in frustum-shaped manner in the flow direction on the outer circumference, is internally traversed by a linear nozzle channel 51 of a roughly constant width and forms at the free end a nozzle opening 53 located in the axis 10*a*, and which in spaced manner, faces the inner end 15*a* or end face 30*a*, said spacing being roughly the same or smaller than half the axial extension of the chamber 35*a* or the width of the nozzle opening 53. On the circumference, the nozzle opening 53 is bounded by a cross-sectionally acute-angled sharp tear-off or ring edge 52, which is bounded on the inner circumference by the channel 51 and on the outer circumference by the conical outer face of the projections 48.

The end channel 14*a* is widened in frustum-shaped manner from the inner to the outer end 16*a* and the width of its inner end 15*a* is greater than the width of the equiaxial, upstream spaced nozzle opening 53. The preatomizing nozzle 50, constructed like the end channel 14*a* in one piece with the body 2*a*, assumes in any operating state the same position with respect to the end channel 14*a*. The intake end of the channel 51 remote from the nozzle opening 53 issues into the valve seat 28*a*. In the case of an overpressure in the pressure chamber 8*a*, the valve 17*a* increasingly opens, while simultaneously the valve 18*a* associated with the nozzle 50 increasingly closes. Approximately over the entire axial extension, the outlet channel 12*a* issues radially and/or tangentially in the described way into the chamber 35*a*, so that the second medium is given a circular rotary flow around the projection 48. The chamber is entered by the first medium sprayed into the center from the opening 53, namely in the gap region formed between the faces 30*a*, 52 and which brings about a strong flow acceleration. On leaving the opening 53, the first medium can have the same or oppositely directed rotary flow.

As from the vicinity of the opening 53, the media mix are strongly whirled up again on flowing along the inner, acute-angled, sharply flanked ring edge of the inner end 15*a* and pass out at the medium outlet 13*a* as a more strongly atomized spray cone. Due to the fact that with the nozzle 50 only the first medium is atomized in a first stage, and in particular accompanied by the supply of the second medium, and then both media are jointly atomized with the nozzle 14*a* in a second, separate stage, extremely small atomized particles uniformly distributed over the spray jet cross-section are obtained. There is a high constancy with respect to these characteristics from the start to finish of the discharge process.

The pressure chamber for the outlet channel 12*a* can also be formed by the cylinder chamber of a manually operable thrust piston pump, which is to be repeatedly filled during the return stroke from a separate medium reservoir or from the atmosphere by subsequent suction by means of an admission valve. In this connection, two e.g. equiaxial, separate pumps or pressure chambers can be simultaneously operated with a common handle. During the return of the core body 21*a* counter to the flow direction, the volume of the chamber 34*a* or 35*a* is increased again and as a result of the underpressure formed, the supply of the first medium to the end channel 14*a* is suddenly broken off or said medium is sucked back.

Each feature of each of the embodiments can be provided in each of the other embodiments. The indicated characteristics, such as sizes, relative positions, actions or the like can be provided precisely as described, in slightly diverging manner, substantially as described or varying therefrom to a greater or lesser extent, depending on the discharge characteristics required or the characteristics, particularly flow characteristics, of the first and/or second medium.

I claim:

1. A dispenser for discharging media to be used in conjunction with a pressure chamber comprising:

a medium outlet defined by a first duct end of a linear end duct including a second duct end remote from said first duct end;

an outlet channel leading into said medium outlet, said outlet channel defining a medium flow with a flow direction toward said medium outlet in operation, said outlet channel, at a distance from said medium outlet, having a channel portion provided to connect to said pressure chamber and operable for producing a delivery pressure in a range of increasing medium pressures, from a relatively lower medium pressure to a relatively higher medium pressure, said outlet channel having adjustable passage cross-sections; and, control means including a control member, said control member being unidirectionally moveable from an initial control position to a control end position in a first control direction for increasing said passage cross-sections to a relatively larger cross-section at said relatively lower medium pressure and to constrict said passage cross-sections smaller than said relatively larger cross-section at said relatively higher medium pressure, said control member entirely closing said passage cross-sections when said control member is in said initial control position and is in said control end position.

2. The dispenser according to claim 1, further comprising:

a core body bounding said outlet channel commonly with said control member, said core body being operationally movable for varying the medium flow, in said first control direction said core body being movable in a first core motion for modifying the medium flow together with the increasing medium pressure to thereby vary at least one of said passage cross-sections; and, means for moving said core body in a second core motion defining a second control direction substantially distinct from said first control direction, said control means controlling said core body as a function of the delivery pressure, said second duct end traversing a recessed seat end face opposing a core end face of said core body, at said medium outlet the medium being dispensed free of said dispenser, when in said control end position said core end face abutting against said seat end face around said second duct end while said passage cross-sections are constricted but open between said seat end face and said core end face and while said passage cross-sections are closed upstream of said core end face.

3. The dispenser according to claim 2, wherein the medium flow includes a partial medium flow nearest to said core body and flowing toward said medium outlet in a partial flow direction, an opposing direction being defined and oriented counter to said partial flow direction, with the increasing medium pressure, said core body being movable in said first control direction distinct from said opposing direction, said core body directly connecting to the medium flow and providing a boundary of said outlet channel.

4. The dispenser according to claim 2, further comprising:

a discharge closure including a valve member for closing said passage cross-sections when said control member is in said initial position, said discharge closure being openable together with an actuating motion provided for producing the delivery pressure; and, a displacing spring for displacing said core body, said displacing spring being located upstream of said valve member, said control member including said valve member.

5. The dispenser according to claim 2, further comprising a discharge valve having an operationally movable valve member for opening and closing said outlet channel upstream of said core end face, said core body defining a motion path extending from said initial control position up to said control end position, said core body being entirely movable over said motion path substantially synchronously with said valve member, said control member including said core body and said valve member in one part.

6. The dispenser according to claim 5, wherein said control member includes a control stem projecting upstream over said valve member, said valve member including a valve seat face located radially outside said control stem, said valve seat face closing said outlet channel when in said initial control position and at a closing location downstream of said control stem.

7. The dispenser according to claim 6, wherein said valve member comprises an end face, said at least one core body being disposed at said end face, said end face closing said outlet channel when in said control end position.

8. The dispenser according to claim 6, wherein said control member has a circumferential extension, and said outlet channel issues from upstream of said circumferential extension radially inwardly against said control member only over part of said circumferential extension and downstream of said discharge valve closing said pressure chamber with respect to said medium outlet only when in said initial control position and in said control end position.

9. The dispenser according to claim 2, further comprising at least two flow throttles including first and second flow throttles commonly bounded by said core body, said first flow throttle including a closing throttle located mostly upstream of said core body and mostly upstream of said second flow throttle, said closing throttle having a circumferentially extending throttle gap, said throttle gap being variable for tightly closing said outlet channel when in said initial control position, said first flow throttle being located downstream of said second flow throttle, and said second flow throttle closing said outlet channel when said second flow throttle is in said control end position.

10. The dispenser according to claim 1, further comprising an end wall traversed by said end duct and bounding said end duct in one part, said control member being disposed directly adjacent to and entirely upstream of said second duct end when in said control end position.

11. The dispenser according to claim 10, wherein from said medium outlet the medium is dispensed free of said dispenser, said end wall including a seat face traversed by said second duct end and opposing said control member, said control member including a core body directly opposing said second duct end and defining a core length extension and a core width extension, said end duct defining a duct length extension smaller than said core length extension and a duct width extension smaller than said core width extension.

12. The dispenser according to claim 1, wherein said control means are included for moving said control member counter to said first motion direction, said moving means including a spring member resiliently urging said control member towards said initial control position, said control member including a valve member closing said outlet channel when in said initial control position, said spring member being located upstream of said valve member.

13. The dispenser according to claim 1, further comprising a closure insert exclusively annular and having a closure seat closing said passage cross-sections together with said control member when in said initial control position, said at least one control member being supported against said closure insert when said initial control position, said closure seat and said control member including first and second seat face interengaged when closing said passage cross-sections, at least one of said seat faces being conically widened in said first control direction, said control member including a third seat face closing said outlet channel commonly with a fourth seat face when said control end position, said fourth seat face being located between and spaced from both said end duct and said first seat face of said closure insert.

14. The dispenser according to claim 13, wherein said closure insert is made in one part and directly supports against a neck of said pressure chamber, radially outside of said first and second seat faces said closure insert providing a seal for the pressure chamber, said control member entirely traversing said closure insert.

15. The dispenser according to claim 1, further comprising at least two flow throttles including first and second flow throttle for said outlet channel bounded by said control member, said first flow throttle being located downstream of said second flow throttle, when in said control end position said second flow throttle closing said outlet channel, said at least two throttles simultaneously and reciprocally widening and narrowing said passage cross-sections.

16. The dispenser according to claim 15, wherein said at least two throttle provide frontal throttle gaps, said second flow throttle including an upstream throttle and a downstream throttle separated from and located downstream of said upstream throttle, said upstream throttle closing said outlet channel when said upstream throttle is in said control end position and said downstream throttle being constricted but open for passing the medium.

17. The dispenser according to claim 1, wherein said outlet channel comprises two separate outlet ducts including first and second outlet ducts for separate first and second media flows, said outlet ducts being separately connected to said pressure chamber and commonly discharging the first and second media flows, said control member closing said first outlet duct when in said control end position at a closing location, said second outlet duct issuing into said first outlet duct only downstream of said closing location.

18. The dispenser according to claim 17, wherein at said closing location said first outlet duct extends annularly around said control member, when in said control end position said second outlet duct being open with respect to said end duct.

19. A dispenser for discharging media to be used in conjunction with a pressure chamber, said dispenser comprising:

a medium outlet;

an outlet channel having at least two spray nozzles spaced in a medium flow direction, said outlet channel leading into said medium outlet, said outlet channel defining said medium flow in operation, said outlet channel, at a distance from said medium outlet, having a channel portion provided to connect to said pressure chamber and operable for producing a delivery pressure in a range of increasing medium pressures, from a relatively lower medium pressure to a relatively higher medium pressure, said outlet channel having adjustable passage cross-sections; and, control means for increasing said passage cross-sections to a relatively larger cross-section at said relatively lower medium pressure and to constrict said passage cross-sections smaller than said relatively larger cross-section at said relatively higher medium pressure.

20. The dispenser according to claim 19, further comprising a turbulence chamber, said at least two spray nozzles including a first spray nozzle located upstream of a second spray nozzle having an inlet end and issuing into said turbulence chambers said turbulence chamber being widened with respect to both said first and second spray nozzles and being located upstream of said inlet end of said second spray nozzle.

21. The dispenser according to claim 19, wherein said at least two nozzles include a first spray nozzle located upstream of a second spray nozzle, said first spray nozzle having a nozzle duct with an inlet end, said at least one core body controlling said first spray nozzle at said inlet end.

22. A dispenser for discharging media to be used in conjunction with a pressure chamber, comprising:

a medium outlet defined by a first duct end of a linear end duct including a second duct end remote from said first duct end;

an outlet channel leading into said end duct, said outlet channel defining a medium flow with a flow direction toward said medium outlet during dispensing operation, said outlet channel having a channel portion directly connecting to said end duct, said channel portion including channel boundaries including an inner circumferential surface and a recessed end face directly connecting to said inner circumferential surface, said channel portion connecting to said pressure chamber and being operable for producing a delivery pressure in an increasing range between a relatively lower medium pressure and a relatively higher medium pressure, said channel portion determining passage cross-sections;

a core body operatively bounding said channel portion opposite to said channel boundaries, said core body being operationally unidirectionally movable from an initial control position to a control end position in a first control direction defined by a first core motion for varying the medium flow and for modifying the medium flow together with the increasing medium pressure to thereby vary said passage cross-sections, wherein said core body has outer faces including an outer circumferential face and a free end face, said outer faces directly facing said channel boundaries, in said initial control position of said core body and of said dispenser, said outer faces and said channel boundaries commonly bounding an angular passage gap for passing the medium, said angular passage gap including an axial gap lea defining first flow cross-sections, said first flow cross-sections being constant during said first core motion and said dispensing operation, said passage grap including a transverse gap leg directly connecting to said axial gap leg at an angle and defining second flow cross-sections, said second flow cross-sections varying substantially continuously during said first core motion and said dispensing operation, said transverse gap lea being oriented transverse to said first control direction and being located downstream of said axial gap leg, said transverse gap leg being bounded by a groove.

23. A dispenser for discharging media to be used in conjunction with a pressure chamber, comprising:

a medium outlet defined by a first duct end of a linear end duct including a second duct end remote from said first duct end;

an outlet channel leading into said end duct, said outlet channel defining a medium flow with a flow direction toward said medium outlet during dispensing operation, said outlet channel having a channel portion at a distance upstream from said medium outlet, said channel portion connecting to said pressure chamber and being operable for producing a delivery pressure in an increasing range from a relatively lower medium pressure to a relatively higher medium pressure, said outlet channel determining passage cross-sections;

a core body operatively associated with said outlet channel and movable during said dispensing operation in a first control direction from an initial control position to a control end position by a first core motion for varying the medium flow, said core body being movable in said first core motion for modifying the medium flow together with the increasing delivery pressure to thereby vary at least one of said passage cross-sections;

said core body having a circumferential face and an end face connecting to said circumferential face; and, said channel portion including at least one angular channel groove, said at least one angular channel groove including an axial groove leg located at said circumferential face and a transverse groove leg downstream angularly directly connecting to said axial groove leg, said transverse groove leg being oriented transverse to said first control direction and located at said end face.

24. The dispenser according to claim 23, wherein said transverse groove leg is recessed in said end face including a center chamber, said transverse groove guiding the medium flow radially inwardly into said center chamber.

25. A dispenser for discharging media to be used in conjunction with a pressure chamber, comprising:

a medium outlet defined by a first duct end of a linear end duct including a second duct end remote from said first duct end;

an outlet channel leading into said end duct, said outlet channel defining a medium flow with a flow direction toward said medium outlet during dispensing operation, said outlet channel having a channel portion at a distance upstream from said medium outlet, said channel portion connecting to said pressure chamber and being operable for producing a delivery pressure in an increasing range from a relatively lower medium pressure to a relatively higher medium pressure, said outlet channel determining passage cross-sections;

a core body operatively bounding said channel portion, said core body being operationally unidirectionally movable from an initial control position to a control end position in a first control direction defined by a first core motion for varying the medium flow, said core body being movable in said first core motion for modifying the medium flow together with the increasing delivery pressure to vary at least one of said passage cross-sections;

opposing end faces including a most downstream end face on said core body being included, said end face being bounded by a circumferential face defining an imaginary circumferential envelope, said opposing end faces further including a counter face directly opposing said end face, said end face approaching said counter face during said first core motion; and, flow control means recessed in one of said end faces, said flow control means including at least one depression located within said circumferential envelope, said flow control means imparting a turbulence to the medium flow.

26. A dispenser for discharging media, comprising:

a squeeze bottle bounding said pressure chamber;

a medium outlet;

an outlet channel leading into said medium outlet said outlet channel defining a medium flow during dispensing operation, said outlet channel having a channel portion at a distance from said medium outlet, connected to said pressure chamber and operable for producing a delivery pressure in an increasing range of pressure, said outlet channel determining passage cross-sections;

a holding spring for said at least one core body, said holding spring engaging inside said pressure chamber and said squeeze bottle bounding said pressure chamber;

at least one core body operatively associated with said outlet channel, said at least one core body being operationally movable for varying the medium flow, said at least one core body being movable in a first core motion for modifying the medium flow together with the increasing delivery pressure to vary at least one of said passage cross-sections; and, means for moving said at least one core body in a second core motion substantially distinct from said first core motion.

* * * * *

UNITED STATES PATENT AND TRADEMARK OFFICE

CERTIFICATE OF CORRECTION

PATENT NO. : 5,803,311
DATED : September 8, 1998
INVENTOR(S) : Fuchs

It is certified that error appears in the above-identified patent and that said Letters Patent is hereby corrected as shown below:

Claim 13, column 12, line 1, after "when" insert --in--.

Claim 13, column 12, line 3, replace "face" with --faces--.

Claim 13, column 12, line 7, after "when" insert --in--.

Claim 21, column 13, line 8, after "two" insert --spray--.

Claim 22, column 13, line 46, replace "lea" with --leg--.

Claim 22, column 13, line 49, replace "grap" with --gap--.

Claim 22, column 13, line 54, replace "lea" with --leg--.

Signed and Sealed this

Sixteenth Day of November, 1999

*Attest:*

Q. TODD DICKINSON

*Attesting Officer*

*Acting Commissioner of Patents and Trademarks*